US010137594B2

(12) United States Patent
Murray

(10) Patent No.: US 10,137,594 B2
(45) Date of Patent: Nov. 27, 2018

(54) SINGLE STEP CREOSOTE/BORATE WOOD TREATMENT

(75) Inventor: Gordon Murray, North River (CA)

(73) Assignee: Stella-Jones Inc., Saint-Laurent, Quebec (CA)

( * ) Notice: Subject to any disclaimer, the term of this patent is extended or adjusted under 35 U.S.C. 154(b) by 151 days.

(21) Appl. No.: 12/983,580

(22) Filed: Jan. 3, 2011

(65) Prior Publication Data

US 2012/0171504 A1 Jul. 5, 2012

(51) Int. Cl.

| | |
|---|---|
| ***B27K 3/16*** | (2006.01) |
| ***B27K 3/02*** | (2006.01) |
| ***B27K 3/08*** | (2006.01) |
| ***B27K 3/46*** | (2006.01) |
| ***B27K 5/00*** | (2006.01) |

(52) U.S. Cl.

CPC ..... *B27K 3/163* (2013.01); *B27K 3/0285* (2013.01); *B27K 3/08* (2013.01); *B27K 3/46* (2013.01); *B27K 5/001* (2013.01); *Y10T 428/31989* (2015.04)

(58) Field of Classification Search

None

See application file for complete search history.

(56) References Cited

U.S. PATENT DOCUMENTS

| | | | | |
|---|---|---|---|---|
| 2,051,486 | A * | 8/1936 | Kautter | 564/477 |
| 3,956,100 | A | 5/1976 | Todd | |
| 3,960,969 | A | 6/1976 | Greco et al. | |
| 4,076,871 | A * | 2/1978 | Short et al. | 427/397 |
| 4,461,721 | A | 7/1984 | Goettsche et al. | |
| 4,585,795 | A | 4/1986 | Linderborg | |
| 4,929,454 | A | 5/1990 | Findlay et al. | |
| 5,078,912 | A * | 1/1992 | Goettsche et al. | 252/400.53 |
| 5,098,472 | A * | 3/1992 | Watkins et al. | 106/15.05 |
| 5,104,664 | A | 4/1992 | Palmere et al. | |
| 5,246,652 | A | 9/1993 | Hsu et al. | |
| 5,296,240 | A | 3/1994 | Palmere et al. | |
| 5,447,686 | A * | 9/1995 | Seidner | 422/26 |
| 5,460,816 | A | 10/1995 | Palmere et al. | |

(Continued)

FOREIGN PATENT DOCUMENTS

| | | |
|---|---|---|
| GB | 0 249 698 | 4/1926 |
| WO | WO 2009129587 A1 * | 10/2009 |

OTHER PUBLICATIONS

Webb et al., 1958 Cooperative Creosote Project-XIV: 35 Years of Field Experience with Posts, AWPA Proceedings, 1995, vol. 91, pp. 120-125.

(Continued)

*Primary Examiner* — Chinessa T. Golden

(74) *Attorney, Agent, or Firm* — Foley & Lardner LLP

(57) ABSTRACT

Disclosed is a method of reducing insect and microbial decay in wood. The method comprises the steps of:

a) immersing the wood in a treatment solution comprising i) a $C_1$-$C_6$monoalkanolamine ester of boric acid (e.g., monoethanolamine ester of boric acid) and ii) creosote; and b) exposing the immersed wood from step a) to conditions which cause the release of boron from the $C_1$-$C_6$ monoalkanolamine ester of boric acid (monoethanolamine ester of boric acid) and which cause the boron to migrate into the interior of the wood.

23 Claims, 3 Drawing Sheets

(56) References Cited

U.S. PATENT DOCUMENTS

| | | | | |
|---|---|---|---|---|
| 5,641,726 | A | 6/1997 | Walker | |
| 5,645,828 | A | 7/1997 | Palmere et al. | |
| 5,700,841 | A | 12/1997 | Walker | |
| 5,709,821 | A * | 1/1998 | von Bonin et al. | 252/606 |
| 5,891,921 | A | 4/1999 | Walker | |
| 5,958,463 | A | 9/1999 | Palmere et al. | |
| 6,087,303 | A | 7/2000 | Walker | |
| 6,103,387 | A * | 8/2000 | Yamamoto et al. | 428/482 |
| 6,426,095 | B2 | 7/2002 | Palmere et al. | |
| 6,630,174 | B2 | 10/2003 | Palmere et al. | |
| 6,953,501 | B2 * | 10/2005 | Kelley et al. | 106/15.05 |
| 7,597,902 | B2 | 10/2009 | Palmere et al. | |
| 7,935,182 | B2 | 5/2011 | Humar et al. | |
| 8,709,462 | B2 | 4/2014 | Palmere et al. | |
| 2003/0199655 | A1 * | 10/2003 | Yurugi et al. | 526/320 |
| 2003/0213400 | A1 * | 11/2003 | Thompson | 106/15.05 |
| 2004/0028934 | A1 * | 2/2004 | Preston et al. | 428/537.1 |
| 2005/0013939 | A1 | 1/2005 | Vinden et al. | |
| 2005/0186352 | A1 * | 8/2005 | Hutter et al. | 427/430.1 |
| 2007/0042161 | A1 | 2/2007 | Gibbs | |
| 2007/0151476 | A1 * | 7/2007 | Humar et al. | 106/12 |
| 2011/0039031 | A1 | 2/2011 | Cobham et al. | |
| 2012/0148859 | A1 | 6/2012 | Cobham | |

OTHER PUBLICATIONS

International Search Report for PCT/IB2011/003293 dated Aug. 10, 2012.

Written Opinion for PCT/IB2011/003293 dated Aug. 10, 2012.

Lesar et al. Wood Research, 2008, vol. 53, No. 3, p. 17-26 "Performance of Boron-ethanolamine-quaternary Ammonium Based Wood Preservatives Against Leaching, Wood Decay and Blue Stain Fungi."

Langroodi et al. Proceedings of the 107$^{th}$ Annual Meeting of the American Wood Protection Association, May 15-17, 2011 (May 15, 2011), p. 117.

Roll, "Wood Preservation Category 4b, Study Guide for Commercial Applicators", Ohio Department of Agriculture—Pesticide Regulation—Certification and Training, Aug. 203 Access from: <URL: http://pested.osu.edu/documents/CommStudy/4b%20Wood%20Preservation.pdf> p. 28 under E. Pentachlorophenol Solutions.

* cited by examiner

SINGLE STEP CREOSOTE/BORATE WOOD TREATMENT

BACKGROUND OF THE INVENTION

Wood products have been used as utility poles, railway ties and construction materials in a wide variety of industries. Without proper treatment, wood products deteriorate and are susceptible to weathering, insects (termites, carpenter ants, and beetles), marine borers (mollusks and crustaceans), bacteria and fungi (stains, white rot, soft rot, and brown rot). Wood treatment is required to prevent these problems.

Borates are a broad spectrum insecticide commonly used in the treatment of wood. They have the advantage of being readily diffusible into the interior of wood and exhibit low mammalian toxicity. However, borates have disadvantages in that they are susceptible to leaching and do not adequately protect against soft rot fungi. Exemplary borates include sodium octaborate, sodium tetraborate, sodium pentaborate, boric acid, disodium octaborate tetrahydrate, boron esters and PBA-phenylboronic acid.

Creosote is another chemical commonly used for the treatment of wood. It comprises over 300 different compounds, the majority of which are polycyclic aromatic hydrocarbons. Creosote is a broad spectrum biocide, and, unlike borates, is able to protect against soft rot fungi. However, creosote is unable to penetrate into the interior of heartwood.

A two stage "envelope" treatment process has been developed to address the problems associated with treatment by borates or creosote individually. The wood is first immersed in a borate solution and let set for about six weeks under cover, thereby allowing the borate to diffuse throughout the wood. This first step is followed by treatment with creosote to form a hydrophobic envelope around the wood. The creosote envelope prevents leaching of the borate and is active against soft rot fungi. As such, the envelope treatment is highly effective in reducing and/or preventing wood deterioration due to microorganisms.

However, the two step envelope treatment also suffers from serious drawbacks. First, it requires six week borate treatment to diffuse, which is extremely time consuming and inefficient. Additional time is required for the wood to dry of up to several additional weeks before creosote can be encapsulated.

Finally, extra handling and equipment is required to carry out the process. As such, new methods of applying the envelope treatment that require less time and handling and allow for the use of wood with a higher moisture content are urgently needed.

SUMMARY OF THE INVENTION

Disclosed herein is a one step process for treating wood with borate and creosote. The experiments described herein show that both creosote and boron penetrated railway ties treated with the disclosed one step process. Penetration of creosote stopped at the heartwood and boron diffused beyond the heartwood. Boron penetration was shown colorimetrically using curcumin solution and confirmed by Induced Coupled Plasma Emission Analysis. Penetration of boron into treated railway ties occurred in couple of hours and thereby eliminates the six week borate treatment step. The disclosed one step process can also be used to treat wood with higher moisture content than is compatible with the prior two step process (Examples 7 and 8).

One embodiment of the invention is a method of reducing insect and microbial decay in wood. The method comprises the steps of:

a) immersing the wood in a treatment solution comprising i) a $C_1$-$C_6$ monoalkanolamine ester of boric acid (e.g., monoethanolamine ester of boric acid) and ii) creosote; and b) exposing the immersed wood from step a) to conditions which cause the release of boron from the $C_1$-$C_6$ monoalkanolamine ester of boric acid (monoethanolamine ester of boric acid) and which cause the boron to migrate into the interior of the wood.

Another embodiment of the invention is a method of reducing insect and microbial decay in wood. The method comprises the steps of:

a) immersing the wood in a treatment solution comprising i) a $C_1$-$C_6$ monoalkanolamine ester of boric acid (e.g., a monoethanolamine ester of boric acid) and ii) creosote;

b) pressure impregnating the immersed wood from step a) under conditions which cause the release of boron from the $C_1$-$C_6$ monoalkanolamine ester of boric acid (e.g., monoethanolamine ester of boric acid) and which cause the boron to migrate into the interior of the wood.

Another embodiment of the invention is a method of reducing insect and microbial decay in wood. The method comprises the steps of:

a) immersing the wood in a treatment solution comprising i) a $C_1$-$C_6$ monoalkanolamine ester of boric acid (e.g., monoethanolamine ester of boric acid) and ii) creosote; and b) exposing the immersed wood to a temperature of between 160-240° F. and a pressure of 100-160 pounds per square inch (psi) (preferably 190-210° F. and a pressure of 130-160 psi). The duration of the exposure is at least ten minutes. Alternatively, the duration of the exposure is from ten minutes to ten hours. In yet another alternative, the duration of the exposure is from 20 minutes to 5 hours.

Another embodiment of the invention is a solution comprising: 1) between 3% w/w to 10% w/w of a $C_1$-$C_6$ monoalkanolamine ester of boric acid (e.g., monoethanolamine ester of boric acid); and 2) between 90% w/w and 97% w/w creosote.

Yet another embodiment of the invention is wood coated with or immersed in a solution comprising: 1) between 3% w/w to 10% w/w of a $C_i$-$C_6$ monoalkanolamine ester of boric acid (e.g., monoethanolamine ester of boric acid); and 2) between 90% w/w and 97% w/w creosote.

DETAILED DESCRIPTION OF THE INVENTION

Figure 1:
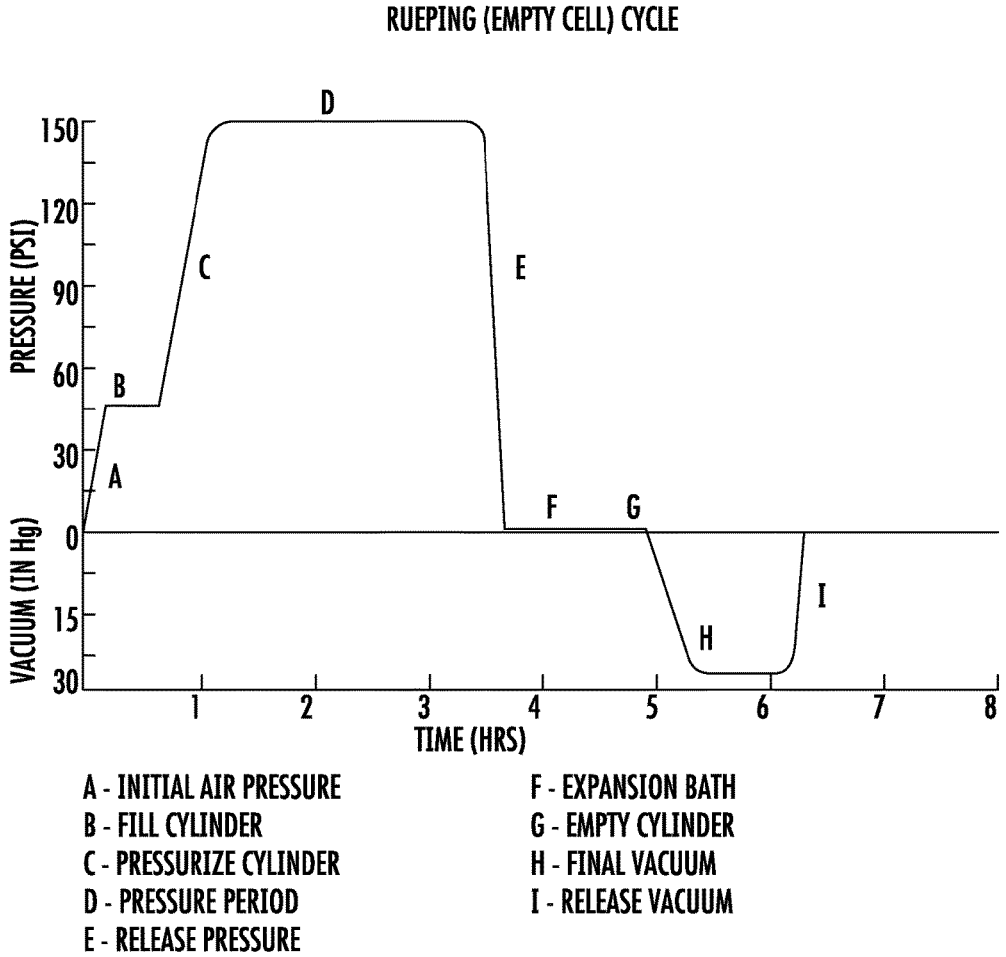
FIG. 1 is a schematic showing the pressure in pounds per square inch or vacuum in inches mercury which are used in the Ruepig Cycle versus time.

The invention is a one step process for treating wood to prevent or reduce insect or microbial decay. The wood is coated or immersed in a treatment solution comprising a $C_1$-$C_6$ monoalkanolamine ester of boric acid (e.g., monoethanolamine ester of boric acid) and creosote. The coated or immersed wood is then exposed to conditions that are suitable for causing release of boron from the borate ester and to cause the released boron to migrate into the interior of the wood.

Creosote is a distillate obtained from tars produced from the carbonization of bituminous coal and is a mixture of over three hundred chemicals such as polycyclic aromatic hydrocarbons (PAHs), phenol and cresols created by high temperature treatment of coal. Creosote is commonly used as a biocide to coat wood and protect it from soft rot fungi and to prevent leaching of boron from the interior.

A $C_2$-$C_6$ monoalkanolamine ester of boric acid can be a monoester of boric acid, a diester of boric acid, a triester of boric acid or a mixture of two or more of the foregoing. Preferably, the $C_2$-$C_6$ monoalkanolamine ester is a monoethanolamine ester of boric acid. A $C_2$-$C_6$ monoalkanolamine ester of boric acid is also referred to herein as a "Borate Ester" and includes any one of the mono, di or tri esters and/or mixtures thereof The monoethanolamine ester of boric acid is preferred and is referred to herein as the "ME Ester".

The $C_2$-$C_6$ monoalkanolamine ester (e.g., an monoethanolamine ester of boric acid) is prepared by mixing $C_2$-$C_6$ monoalkanolamine (e.g., monoethanolamine) in an aqueous solution of boric acid and allowing the $C_2$-$C_6$ monoalkanolamine (e.g., monoethanolamine) to react with the boric acid.

The concentration of $C_2$-$C_6$ monoalkanolamine (e.g., monoethanolamine) in the reaction mixture is 23-43% w/w; the concentration of water in the reaction mixture is 7-27% w/w; and the concentration of boric acid in the reaction mixture is 40-60% w/w. Alternatively, the concentration of $C_2$-$C_6$ monoalkanolamine (e.g., monoethanolamine) in the reaction mixture is 28-38% w/w; the concentration of water in the reaction mixture is 12-22% w/w; and the concentration of boric acid in the reaction mixture is 45-55% w/w. In yet another alternative, the concentration of $C_2$-$C_6$ monoalkanolamine (e.g., monoethanolamine) in the reaction mixture is 31-35% w/w; the concentration of water in the reaction mixture is 15-19% w/w; and the concentration of boric acid in the reaction mixture is 48-52% w/w. The quantity of $C_2$-$C_6$ monoalkanolamine (e.g., monoethanolamine) in the reaction mixture relative to boric acid can be adjusted upward, resulting in greater amounts of di and triester; or downwards, resulting in lesser amounts of di and triester. Because the reaction is exothermic, the esterification reaction of boric acid is preferably carried out with cooling. Because water is preferably substantially absent from the treatment solution used in the pressure impregnation step, it is advantageous to evaporate away as much water as possible from the heat that is generated from the exotherm that occurs during the esterification reaction.

The reaction product of the $C_2$-$C_6$ alkanolamine (e.g., an ethanolamine) is then blended with creosote to form the treatment solution for the pressure impregnation. The temperature of this blending step is not critical, however, the temperature is typically elevated in order to decrease the viscosity of the creosote and thereby facilitate the blending and to remove any remaining water present in the borate ester solution. As such, the temperature and period of time during which the elevated temperature is maintained is adjusted so that the blend is homogeneously mixed and substantially all water has been removed through evaporation (e.g., greater 95%. 98% or 99% w/w free of water). Temperatures between 160-200° F. are commonly used. The final concentration of Borate Ester in the treatment solution is from 10-3% w/w; and the final concentration of creosote in the treatment solution from 90-97% w/w. Alternatively, the final concentration of Borate Ester in the treatment solution is from 5-3% w/w; and the final concentration of creosote in the treatment solution is from 95-97% w/w.

To carry out the disclosed processes, the wood being treated to reduce insect and/or microbial decay is immersed in the treatment solution and subjected to conditions that cause boron to be released from the Borate Ester and to migrate into the interior of the wood. The transfer of the boron from the creosote into the wood is as elemental boron which reacts quickly to form the boric acid equivalent ($B_2O_3$) found in the AWPA texts. This chemical is exchanged back and forth as the material enters the wood. The boron moves from the solution in response to the higher moisture content in the core of the wood and the higher charge associated with heartwood. It moves primarily as B2O3 but quickly reacts with the numerous wood sugars, tannins, acids and natural decay resistant chemicals such as Tropolones and Stilbenes to form numerous complexes.

One great advantage of the disclosed process is that conditions commonly used in the prior two step process to treat wood with creosote alone can be used in the disclosed one step process. For example, pressure impregnation, a process commonly used to coat wood with creosote in the prior two step process, is suitable for use in the disclosed one step process. Whereas pressure impregnation is used in the prior two step process to apply an envelope coating of creosote to the wood being treated, in the disclosed one step process, pressure impregnation is used to both apply the envelope coating of creosote and to cause the Borate Ester to decompose and release boron and to cause the released boron to migrate into the interior of the wood.

Pressure impregnation refers to subjecting wood that is immersed in the treatment solution to elevated temperature and pressure for a period of time sufficient to achieve release of boron and migration of the released boron throughout the interior of the wood to thereby achieve a sufficient concentration of boron to reduce insect and microbial degradation. Suitable concentrations of boron in the interior of the wood are at least 0.05 pounds per cubic foot (pcf) and preferably at least 0.11 pcf. The precise temperature and pressure can vary according to the thickness and type of wood and length of the treatment time. The person of ordinary skill will be able to determine suitable parameters to achieve a suitable concentration and distribution of boron by monitoring the migration of the boron throughout the interior of the wood by, for example, atomic absorption and inductively couple argon plasma Screening can be accomplished, for example, by using the AWPA boron stain to confirm presence or absence of boron in the wood as a rapid screening mechanism.(AWPA A3-08-17, 2010) and adjusting the parameters accordingly. Commonly used conditions for the pressure impregnation include a pressure of between 100-160 psi and a temperature of between 160-240° F. Alternative conditions include a pressure of between 130-160 psi and a temperature of between 190-210° F. Treatment time is at least 10 minutes, 10 minutes to 10 hours or 20 minutes to five hours.

The pressure impregnation is carried out in a pressure vessel. Exemplary pressure vessels include cylindirical retorts that are 5' to 8' in diameter and of lengths up to 200' which allow for the uniform application of temperature, air and fluid pressure and vacuum. They consist of a long cylindrical tube, certified as a pressure vessel which can handle pressures of at least 250 psi, doors must be rated for the same pressure to allow for entry and exit of the wood. The wood is placed into the retort on small railcars or trams. A working solution tank is used to fill the cylinder with the wood present under various pressure and temperature conditions. The retort holds the wood immersed in the chosen treating solution and allows for control of pressure through fluid pumps and air compressors, temperature with heat exchange coils and vacuum with liquid ring pumps. These systems are designed to give uniform conditions throught the volume of the retort so that all areas of the wood are subjected to equal temperature and pressure conditions. Pressure vessels are commercially available from any large steel fabrication facility. Regulations for their design vary from state to state and country to country.

Following pressure impregnation, the wood is separated from the treatment solution. When the process is carried out in a pressure vessel, this is typically accomplished by releasing the pressure and pumping the treatment solution out of the pressure vessel. However, any other suitable means of separating a solid from a liquid can be used, including filtration or centrifugation.

In one embodiment, the cylinder is pressurized with air before it is filled with the treatment solution. This step is referred to herein as "Pretreatment Pressurization". Suitable pressures range from atmospheric pressure to 75 psi. Alternatively, the pressure ranges from 0-25 psi. The Pretreament Pressurization typically lasts from 10 minutes to 10 hours. Alternatively, the Pretreatment Pressurization lasts from 10 minutes to 3 hours. In another alternative, the Pretreatment Pressurization lasts from 20 minutes to one hour. Following Pretreatment Pressurization, the pressure is maintained while the wood is immersed in the treatment solution for pressure impregnation.

Following the pressure impregnation and separation of the wood from the treatment solution, the wood can be subjected to an expansion bath. An expansion bath is used to minimize leaching and bleeding after treatment and to remove excess preservative from the surface of the wood. Leaching refers to precipitation of the preservative on the surface of the wood from where it is often transported in rain/snow away from the wood. Bleeding refers to the movement of preservative resulting from the change of moisture gradient (wet centers), physically moving the preservative to the surface of the material. Subjecting the wood to an expansion bath refers to immersing the wood in a higher temperature oil and subjecting the oil and immersed wood to elevated temperatures, typically a temperature higher than what was used for the pressure impregnation, typically about 10-40° F. higher; alternatively from 10-20° F. higher. Temperatures of 220-250° F. are commonly used, alternatively from 220-230° F. The duration of exposure is at least 30 minutes, alternatively from 0.5 to five hours. In another alternative, the duration is from one to two hours. Examples of suitable high temperature oils include the oils used in the pressure impregnation. For example, the oil mixture used for the pressure impregnation can be conveniently used for the expansion by adjusting the temperature upwards. When the expansion bath treatment is completed, the oil is separated from the wood. When the process is carried out in a pressure cylinder, the oil is typically pumped out of the apparatus. Other suitable separation methods can also be used, e.g., filtration. The separation of the oil from the wood is considered herein to be part of the expansion bath.

The expansion bath treatment and separation of the oil from the treated wood is typically followed by vacuum treatment to remove residual liquid. The final vacuum is carried out at at least 10 inches of mercury and typically between 15 and 40 inches, more commonly between 20 and 28 inches of mercury. The duration of the vacuum treatment is for at least 15 minutes, alternatively from 0.5 to ten hours and in another alternative from 0.5 to five hours and in another alternative from 0.5 to two hours.

Figure 2:
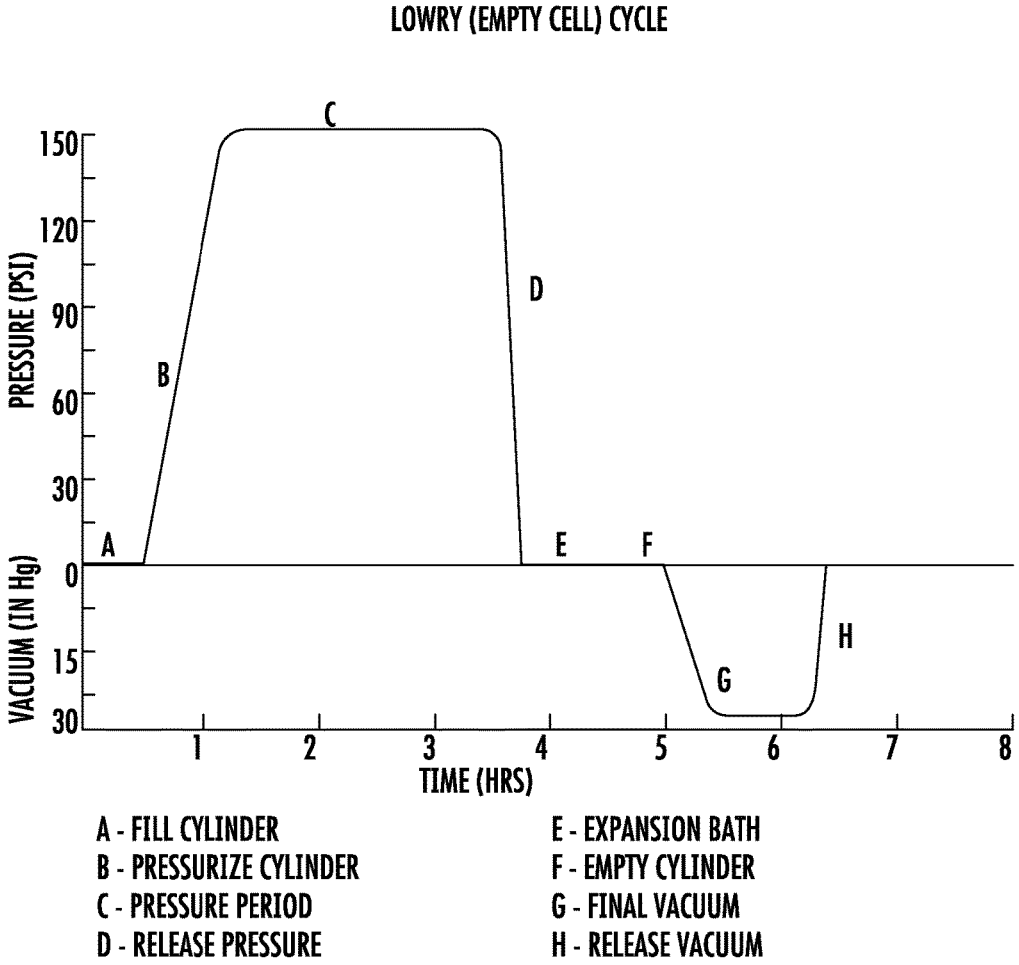
FIG. 2 is a schematic showing the pressure in pounds per square inch or vacuum in inches mercury which are used in the Lowry Cycle versus time.

The Lowry Process and Ruepig Process are well known in the art for applying an envelope coating of creosote to wood. Both of the processes are suitable for the disclosed one step wood treatment process for impregnating wood with boron and envelope coating the wood with creosote. The pressure and vacuum conditions used over time for both of these processes are shown schematically in FIGS. 1 and 2. The Lowry Process and Ruepig Process are described more fully in the AWPA (AWPA T1-10, 2010).

The prior two step process requires the use of wood that is dry, i.e., has a moisture content between 20-40% w/w. Because the moisture content of most wood is greater than 20-40% w/w, a drying step is often necessary before the prior two step process can be employed. Moisture can be removed from wood by, for example, immersing the wood in oil at elevated temperature under vacuum, e.g., at around 180° F. at 24 inches Hg. While the disclosed process can readily treat "dry" wood, one advantage of the disclosed one step process compared with the prior two step process is that wood does not need to be rigorously dried in order to be treated by the disclosed one step process. Specifically, the disclosed process can also be used to treat wood that is "semi dry" (i.e., a moisture content of between 40-70% w/w) and "wet" (i.e., a moisture content above 70% w/w). Moreover, the disclosed process is not limited to any particular type of wood. Examples of wood that can be used in the disclosed process include, but are not limited to, Pine (e.g., Red Pine, Jack Pine, Southern Yellow Pine, Lodgepole Pine), Fir (e.g., Douglas Fir), Western Red Cedar, Spruce, Eastern and Western Hemlock and hardwoods (e.g., Oak).

Wood is commonly in the form of a cant when treated according to the disclosed process. A cant is the square section of timber that follows the removal of the outer bark.

The invention is illustrated by the following examples which are not intended to be limiting in any way.

EXEMPLIFICATION

Example 1

Preparation of a Borate/Creosote Solution

All boron sources used were AWPA 2010 compatible and expressed as Boric Acid Equivalent (BAE) which is $B_2O_3$. The objective was to determine whether Tim-Bor (disodium octaborate tetrahydrate or D.O.T.) could be dissolved in creosote, or a co-solvent which could then be added to creosote.

Treatments: Monoethanolamine Borate Ester
- Monoethanolamine (non-ester)
- creosote
- biodiesel Control: water Replications: Each treatment was replicated three times.

Ten grams of Tim-Bor was added to round bottomed flasks containing 100 mL of each treatment. The flasks were then attached to a rotary evaporator (Büchi R-124) for 1 hour at 60 rpm and a temperature of 80° C.

All results were qualitative in nature, did the Tim-Bor dissolve in the treatment or not? The basis of this was, if the solution was free of clumps or clouds then the Tim-Bor was considered to be dissolved. The flasks were then capped and allowed to cool for 24 hours at which time the solution was checked to ensure the Tim-Bor remained dissolved in the solvent.

The only treatment to dissolve the Tim-Bor was the monoethanolamine borate ester. Through further testing it was determined that up to 40g Tim-Bor could be dissolved in 100 mL monoethanolamine borate ester (MBE) using the above described rotary evaporator method.

Example 2

Effect of Varying Amounts and Types of Borate Preservatives Added to Creosote on Diffusion of Borate into Wood Treated with the Disclosed one Stage Process The objective was to examine the effect of varying amounts and types of borate preservatives added to creosote on diffusion of borate into wood treated with one stage creosote/borate in a mini-pilot wood treating plant.

Treatments: 1% Tim-Bor
- 1% Tim-Bor/monoethanolamine borate ester
- 1% monoethanolamine borate ester
- 5% Tim-Bor
- 5% Tim-Bor/monoethanolamine borate ester
- 5% monoethanolamine borate ester Control: 100% creosote Twenty-eight hardwood stakes were cut measuring 2 in×2in×12in each. 2 L of each preservative treatment mixture was needed per charge in the mini-pilot wood treating plant (Canadian Erectors Manufacturing Ltd.). The wood stakes were treated using the Lowry process with a steam coil heater operating at 180° F. during the initial bath and pressure cycle. Each charge took approximately 6 hours. Following each charge, 2 of the stakes were wrapped in plastic wrap and 2 stakes were left unwrapped. All stakes were placed in storage in a covered bin in an unheated building. The stakes were tested for borate diffusion at 3 and 6 weeks using AWPA method A3-08 (Method for determining penetration of boron-containing preservatives and fire retardants). At the end of each sampling period, a wrapped and unwrapped stake from each treatment was cut in half and the cut edge was sprayed with the indicator solution to determine borate diffusion.

After 3 weeks of storage the stakes were tested for boron diffusion. Following the application of the indicator solutions (AWPA method A3-08), with the exception of control, it was observed that each sample turned an orange/red color, which indicates that borate diffused through the wood. The stakes were tested again at 6 weeks with the same diffusion results.

The indicator solutions test showed that neither the color intensity nor depth of boron diffusion differed between the 5% Tim-Bor/MBE and the 5% MBE treatments. The ICP results indicated only a slight increase in B concentration in the treated wood. The concentration of boric acid in the monoethanolamine was increased to assess whether the same BAE (boric acid equivalent) could be achieved in the treated wood. In fact, it proved possible to increase the concentration of boric acid in the MBE from 30% to 52%.

A stabilizer was required to prevent the boron from coming out of solution. To adopt more environmentally sensitive technologies, biodiesel was chosen as the stabilizer. Biodiesel is already being used as a component of the carrier oil within the oil-borne preservative wood treating system and therefore its use would not require any equipment upgrades. Odor suppression is a side benefit of this project.

Example 3

Amount of Stabilizer Required to Prevent From Coming out of Solution

Experiment were undertaken to determine the minimum amount of stabilizer, in the form of biodiesel, that needs to be added to the highly concentrated MBE (52% boric acid) to prevent boron from coming out of solution and forming deposits.

Treatments: 50% monoethanolamine borate ester/50% biodiesel
- 75% monoethanolamine borate ester/25% biodiesel
- 85% monoethanolamine borate ester/15% biodiesel
- 90% monoethanolamine borate ester/10% biodiesel Control: 100% monoethanolamine borate ester (52%)

Fifteen 3.8L metal containers were each half filled with the appropriate treatment or control. The contents were agitated by stirring and the solution was allowed to coat the sides of the cans. This was to mimic the handling of drums prior to transport and storage. The containers were then allowed to sit undisturbed for a period of one month. The container contents were checked weekly and observations were made on the occurrence of boron deposits.

After 1 month, all metal containers containing MBE/biodiesel mixtures were absent of boron deposits. It was determined that biodiesel was an effective stabilizer for the concentrated MBE.

An added feature that became apparent from adding biodiesel to the concentrated MBE was the decrease in viscosity of the mixture as compared to the ester alone. The concentrated MBE is very viscous and can be difficult to work with in the field. It was determined through employee survey that the 85% MBE/15% biodiesel mixture was most desirable for ease of handling and performance pertaining to equipment (i.e. reduced number and size of emulsions which clog equipment lines). The biodiesel is added to the concentrated MBE by the manufacturer before shipping and therefore does not add an additional step to the procedure at the wood treating plant level. Though we have not tried them at the full production level we are as high as 69% boric acid with 10% biodiesel.

Example 4

Efficacy Testing of Wood Treated by the Disclosed Process

Given the time constraints the proposed treating solutions were subjected to testing by the ASTM test fungi in Petri dishes. This allows for the most rapid determination of efficacy in the ideal growth conditions for the fungi of concern. Agar plate tests using the specified test fungal cultures was then performed on those MBE solutions selected for delivery of the boron. The certified cultures were obtained from the American Type Culture Collection (ATTC) and propagated as per the product information sheets:

*Irpex lacteus:* ATTC number 11245, yeast medium Difco 0712 (ATTC medium no. 200)

*Neolentius lepideus:* ATTC number 12653, YM agar Difco 0712 (ATTC medium no. 200)

*Postia poria:* ATTC number 11538, YM agar Difco 0712 (ATTC medium no. 200)

*Pleurotus ostreatus:* ATTC number 32237, YM agar Difco 0712 (ATTC medium no. 200)

*Trametes versicolor:* ATTC number 42462, Hagem's-Modess medium (ATTC medium no. 479)

*Gleoephyllum trabeum:* ATTC number 11539, Potato Dextrose Agar with 0.5% yeast extract (ATCC medium no. 337)

Each plate was then inoculated in a flame induced sterile environment with a 5 mm diameter agar plug fungal colony of those fungi listed (Hill and Stratton, 1991). Plates subsequently received surface application, rather than an incorporation method, of the 0.5 ml and 1 ml of the new blend solutions from the supplier at concentrations of 5 and 8%, creosote with the 5 and 8% blends and controls with only the fungal colony. This was in keeping with the poisoned agar technique used by Stratton, 1989 and modified by Hill and Stratton in1991. The plates were incubated for 14 days at 30C and the presence or absence of fungal growth was noted and measured.

The results of agar plate testing are shown in Table 1 and 2. Primary concern was with boron efficacy and the agar used represents the ideal media for the growth of fungi in an environment much more hospitable than any found in nature. The growth of fungi was completely inhibited at all concentrations and additions of the proposed boron esters and blends. Some plates showed minor cross contamination of bacterial colonies at the 0.5 ml addition. The spotting was present randomly, over the surface of the plates on both strengths of boron esters. Growth was not related to the fungal colony. Controls showed complete coverage of the plate.

TABLE 1

Agar Plate Testing with MBE solutions and MBE/creosote blends and 5 and 8% solutions and blends with creosote with controls - 1 ml.

| | | | MBE Blends | | MBE/Creo blend | |
|---|---|---|---|---|---|---|
| Fungi | Replications | Control | 5% | 8% | 5% | 8% |
| 11245 | 7 | FPG | NG | NG | NG | NG |
| 12653 | 7 | FPG | NG | NG | NG | NG |
| 11538 | 7 | FPG | NG | NG | NG | NG |
| 32237 | 7 | 95% | NG | NG | NG | NG |
| 42462 | 7 | FPG | NG | NG | NG | NG |
| 11539 | 7 | FPG | NG | NG | NG | NG |

FPG—Full growth of Fungi on Plate Agar
NG—No Growth of Fungi on Plate Agar

TABLE 2

Agar Plate Testing with MBE solutions and MBE/creosote blends and 5 and 8% solutions and blends with creosote with controls - 0.5 ml.

| | | | Boron Ester Blends | | Boron Ester/ Creo blend | |
|---|---|---|---|---|---|---|
| Fungi | Replications | Control | 5% | 8% | 5% | 8% |
| 11245 | 7 | FPG | NG | NG | NG | NG |
| 12653 | 7 | FPG | NG | NG | NG | NG |
| 11538 | 7 | FPG | NG | NG | NG | NG |
| 32237 | 7 | 95% | NG | NG | NG | NG |
| 42462 | 7 | FPG | NG | NG | NG | NG |
| 11539 | 7 | FPG | NG | NG | NG | NG |

Example 5

Soil Block Culture of Wood Treated With the Disclosed One Step Process

Blocks (14-19 mm) hardwood were tested at various retentions of MBE/Creosote in a 5 step retention series. This allowed for the exposure of the treated blocks to recognized destructive species of fungi outlined above. These blocks were exposed for periods of up to 16 weeks at 25 -27 degrees Celcius and 65-75% relative humidity. Efficacy was evaluated as mass loss on each block. This method is presented in E10-09 in the AWPA 2010 standards.

Results showed very small mass loss with MBE and creosote blends ranging from 2% to 10%. The blocks retained the majority of their pre-exposure weights as shown in Table 3. Losses are expected from the volatized of the creosote and these loss percentages are to be expected.

TABLE 3

Mass loss of soil blocks when subjected to AWPA E10-09.

| | | Control | Boron Ester/Creosote blends (mass loss %) | | | | |
|---|---|---|---|---|---|---|---|
| Fungi | Replications | % mass loss | 2% | 4% | 6% | 8% | 10% |
| 11245 | 7 | 60 | 7 | 4 | 6 | 4 | 4 |
| 12653 | 7 | 40 | 8 | 8 | 8 | 8 | 2 |
| 11538 | 7 | 40 | 6 | 6 | 5 | 6 | 5 |
| 32237 | 7 | 50 | 10 | 9 | 4 | 7 | 2 |
| 42462 | 7 | 60 | 6 | 8 | 6 | 4 | 4 |
| 11539 | 7 | 50 | 4 | 3 | 4 | 4 | 4 |

Example 6

MBE Additions Do Not Materially Affect The Properties Of The Creosote Solution

Experiments were undertaken to determine that the MBE additions did not materially affect the properties of the creosote solution as per the AWPA 2010 specification P1-P13-09 and P2-09. Table 4 shows the comparison of a 10% mixture which is the highest concentration ever used with creosote.

TABLE 4

P2-09 Standard for Creosote Solution Preservative Composition & Phys. Chem. Requirements of new material & material in use in treating solution

| | New Material | | Material In Use | | Our Solution at MBE 10% (use) |
|---|---|---|---|---|---|
| Water Content (% by volume) | >1.5 | | >3.0 | | >1.5 |
| Material insoluble by Xylene | 3.5 | | >4 | | >3 |
| Specific Gravity @ 38° C. (compared to Water @15.5° C.) | | | | | |
| Whole Creosote | <1.080 | >1.130 | >1.080 | >1.130 | >1.095 |
| Fraction 235-315° C. | <1.025 | — | >1.025 | — | >1.025 |
| Fraction 315-355° C. | <1.085 | — | >1.085 | — | >1.093 |
| Distillation | | | | | |
| Up to 210° C. | — | <5.0 | — | <5.0 | <4.01 |
| Up to 235° C. | — | <25.0 | — | <25.0 | <23.5 |

TABLE 4-continued

| P2-09 Standard for Creosote Solution Preservative Composition & Phys. Chem. Requirements of new material & material in use in treating solution | | | | | |
|---|---|---|---|---|---|
| | New Material | | Material In Use | | Our Solution at MBE 10% (use) |
| Up to 315° C. | >32.0 | — | >32.0 | — | <34.6 |
| Up to 355° C. | >52.0 | — | >52.0 | — | <54 |

Composition: The material shall be a pure coal tar product derived entirely from tar produced by the carbonization of bituminous coal. It may either be a coal tar distillate or a solution of coal tar in coal tar distillate

Example 7

Optimization of Boron Penetration and Retention Using the Disclosed One-Step Creosote-Borate Treatment Process In order to optimize the boron penetration and retention during the one-step creosote-borate treatment process, operational parameters were varied to determine their effects in addition to variable percentages of MBE. The parameters tested were Boultonizing time and length of pressure cycle. The effect of variable preheating times had little to no effect on $B_2O_3$ retentions within the wood suggesting that a minimal preheat time of 4 hours was sufficient for borate retention. Pressure times were varied from 5 to 120 minutes, however, there was no apparent effect on borate retentions, indicating that borate diffusion occurs rapidly within the early stages of the treating cycle and is predominatly influenced by temperature. Moisture content improved the rate of diffusion allowing wet charges to be treated easily. All data in Table 5 was full scale.

Figure 3:
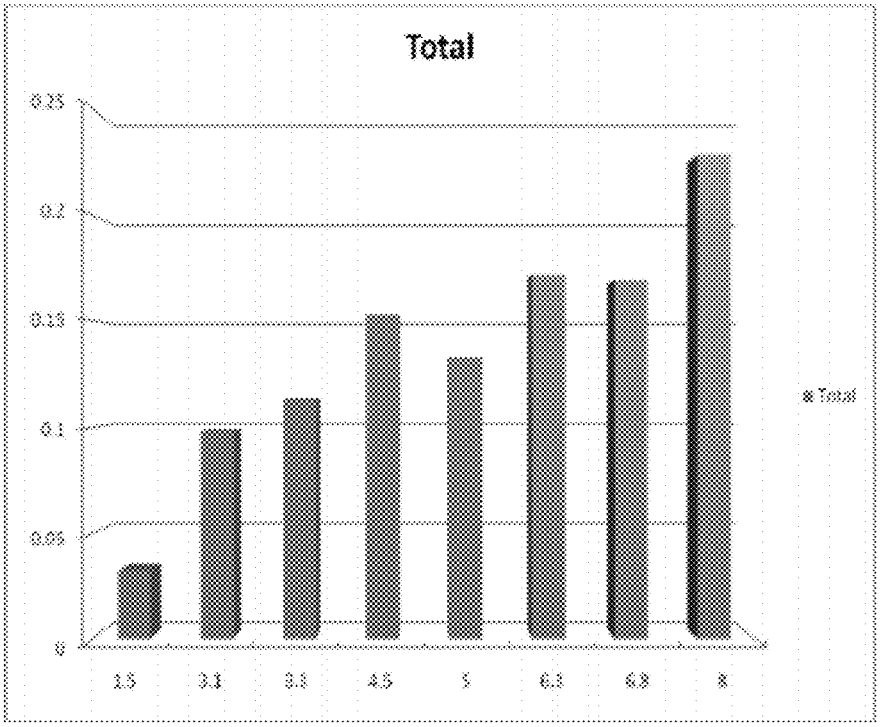
FIG. 3 is a bar graph showing the effect of increasing the concentration of monoethylanime borate in the treatment solution in percent on $B_2O_3$ Retention in oak in pcf (parts per cubic foot).

The percentage MBE within the treating solution appears to have a linear effect on borate retention within both MHW and Oak. However, both the MHW and Oak retention data showed a maximum retention of approximately 0.15 pcf $B_2O_3$ occurring with MBE percentages ranging from 3-6.3. An increase to the retention of borate above 0.17 to 0.23 pcf, required an MBE percentage increase above 6.3%. Once above 6.3%, the borate retention to MBE % relationship was again that of an increasing linear trend. Our target was 0.09 pcf $B_2O_3$ or BAE. This was easily exceeded as shown in FIG. 3.

TABLE 5

| Variable boltonizing/pressure times and the subsequent effect on $B_2O_3$ retentions. | | | | |
|---|---|---|---|---|
| Species | MBE % | Boultinizing Time H | Pressure Time Min | $B_2O_3$ Retention PCF (Average) |
| MHW | 4.5 | 4 | 5 | 0.156 |
| Oak | 4.5 | 4 | 5 | 0.161 |
| MHW | 6.3 | 4.5 | 20 | 0.164 |
| Oak | 6.3 | 4.5 | 20 | 0.158 |
| MHW | 3.1 | 4.5 | 75 | 0.151 |
| Oak | 3.1 | 4.5 | 75 | 0.047 |
| MHW | 6.3 | 4.5 | 75 | 0.172 |
| Oak | 6.3 | 4.5 | 75 | 0.164 |
| MHW | 6.8 | 5 | 5 | 0.108 |
| Oak | 6.8 | 5 | 5 | 0.184 |
| MHW | 8.0 | 5.5 | 30 | 0.222 |
| Oak | 8.0 | 5.5 | 30 | 0.239 |
| MHW | 3.3 | 5.5 | 75 | 0.099 |
| Oak | 3.3 | 5.5 | 75 | 0.093 |
| MHW | 1.5 | 5.5 | 60 | 0.031 |
| Oak | 1.5 | 5.5 | 60 | 0.035 |

TABLE 5-continued

| Variable boltonizing/pressure times and the subsequent effect on $B_2O_3$ retentions. | | | | |
|---|---|---|---|---|
| Species | MBE % | Boultinizing Time H | Pressure Time Min | $B_2O_3$ Retention PCF (Average) |
| MHW | 1.5 | 5.5 | 30 | 0.030 |
| Oak | 1.5 | 5.5 | 30 | 0.026 |
| MHW | 5.0 | 5.5 | 5 | 0.091 |
| Oak | 5.0 | 5.5 | 5 | 0.117 |
| MHW | 5.0 | 5.5 | 20 | 0.127 |
| Oak | 5.0 | 5.5 | 20 | 0.161 |
| MHW | 5.0 | 5.5 | 30 | 0.154 |
| Oak | 5.0 | 5.5 | 30 | 0.158 |
| MHW | 5.0 | 5.5 | 40 | 0.155 |
| Oak | 5.0 | 5.5 | 40 | 0.159 |
| MHW | 1.5 | 6.0 | 30 | 0.031 |
| Oak | 1.5 | 6.0 | 30 | 0.038 |
| MHW | 8 | 6.0 | 60 | 0.222 |
| Oak | 8 | 6.0 | 60 | 0.232 |
| MHW | 8 | 6.0 | 90 | 0.219 |
| Oak | 8 | 6.0 | 90 | 0.235 |
| MHW | 8 | 6.0 | 120 | 0.235 |
| Oak | 8 | 6.0 | 120 | 0.225 |

TABLE 6

| MBE concentrations versus $B_2O_3$ Retentions no Boultonizing or Pressure Variations. | | |
|---|---|---|
| Species | MBE % | $B_2O_3$ Retention PCF (Average |
| MHW | 1.5 | 0.031 |
| Oak | 1.5 | 0.033 |
| MHW | 3.1 | 0.098 |
| Oak | 3.1 | 0.097 |
| MHW | 3.3 | 0.118 |
| Oak | 3.3 | 0.143 |
| MHW | 4.5 | 0.156 |
| Oak | 4.5 | 0.140 |
| MHW | 5 | 0.097 |
| Oak | 5 | 0.112 |
| MHW | 6.3 | 0.187 |
| Oak | 6.3 | 0.187 |
| MHW | 6.8 | 0.198 |
| Oak | 6.8 | 0.187 |
| MHW | 8 | 0.224 |
| Oak | 8 | 0.233 |

Example 8

The Disclosed One Step Process Can Be Applied to "Wet" Wood

The disclosed one step process was tested on "wet" wood. The wood was first treated to remove moisture.

Wet wood was loaded into the cylinder or retort, which was then filled with the creosote and boron mixture. The temperature was then raised to around 200F while pulling a vacuum to cause the water within the wood to be evaporated off to collection tanks. Pressure is the time for the press and switch ties are pressed longer as they are larger in dimensions. Boultonizing preheat time is the time that the wood is boiled under vacuum to extract water. Specific conditions are provided in Table 7. The process was monitored to avoid the equalization of moisture that can cause the expulsion of preservative or bleeding. The amount of boron in the wood was then assessed and the results are shown in Table 7 below. In Table 6, "MHW" is mixed hardwood, $B_2O_3$ and DOT results are from a standard titration procedure. Retention is the pounds of creosote per cubic foot of wood.

TABLE 7

| BORATE RESULTS - Wet Material | | | | | | | | | |
|---|---|---|---|---|---|---|---|---|---|
| | | | CYCLE | | RETENTIONS | | | | |
| MATERIAL | | | Preheating/ Boult | Pressure | | | B203 | Dot | Atomic Absorbtion |
| Species | Pcs | Item | Hours | Time | | % B203 | Lbs/Cuft | Lbs/Cuft | Ppm |
| MHW | 318 | 7" | 6 | 5 MIN | 6.140 | 0.258 | 0.104 | 0.154 | 1470 |
| MHW | 318 | 7" | 5 | 5 MIN | 6.054 | 0.332 | 0.134 | 0.198 | 922 |
| MHW | 318 | 7" | 5 | 5 MIN | 3.546 | 0.221 | 0.099 | 0.154 | 892 |
| MHW | 318 | 7" | 5 | 5 MIN | 6.227 | 0.258 | 0.108 | 0.158 | 1180 |
| OAK | 240 | SWITCH | 17 | 15 MIN | 3.596 | 0.202 | 0.091 | 0.154 | 789 |
| OAK | 192 | SWITCH | 16 | 10 MIN | 4.276 | 0.202 | 0.121 | 0.155 | 845 |
| | | | | | required | | 0.090 | | |

Example 9

Wood Treated with the Disclosed One Step Process Retains the Ability to be Burned as a Fuel Source A burn test was conducted by the ICSET gas emissions laboratory in Bowling Green Kentucky, to compare the combustion of one step, two step and creosote only ties. This confirms that the addition of boron by the one step method does not impact the ability of the tie to be burned as a fuel source for electrical power.

What is claimed is:

1. A wood treatment composition comprising:

(1) at least about 3% w/w of a reaction product of $C_2$-$C_6$ monoalkanolamine and boric acid; and 2) at least about 90% w/w creosote; wherein the reaction product comprises a $C_2$-$C_6$ monoalkanolamine ester of boric acid; and the composition is greater than 98% free of water and is a homogeneous mixture.

2. The composition of claim 1, wherein the $C_2$-$C_6$ monoalkanolamine ester of boric acid is monoethanolamine ester of boric acid.

3. The composition of claim 2, wherein the composition comprises 1) about 3to 5% w/w of the reaction product; and 2) about 95 to 97% w/w creosote.

4. The composition of claim 2, wherein the $C_2$-$C_6$ monoalkanolamine ester of boric acid is a mixture of mono, di and tri esters.

5. The composition of claim 1 wherein the composition is greater than 99% free of water.

6. The composition of claim 1, wherein the reaction product further comprises boric acid.

7. The composition of claim 1, wherein the composition further comprises disodium octaborate tetrahydrate.

8. The composition of claim 1, wherein the composition further comprises biodiesel.

9. The composition of claim 1, wherein the composition comprises about 95to 97% w/w creosote; the $C_2$-$C_6$ monoalkanolamine ester of boric acid comprises monoethanolamine ester of boric acid; and the reaction product further comprises boric acid.

10. The composition of claim 1, wherein the $C_2$-$C_6$ monoalkanolamine comprises monoethanolamine; the $C_2$-$C_6$ monoalkanolamine ester of boric acid comprises a monoethanolamine ester of boric acid; the reaction product further comprises boric acid.

11. The composition of claim 1, wherein the composition comprises at least 3% by weight of the $C_2$-$C_6$ monoalkanolamine ester of boric acid.

12. The composition of claim 1, wherein the composition comprises at least 3% by weight monoethanolamine ester of boric acid.

13. The composition of claim 12, wherein the reaction product further comprises boric acid.

14. The composition of claim 12, wherein the composition further comprises biodiesel.

15. The composition of claim 12, wherein the composition is greater than 99% free of water.

16. The composition of claim 12, wherein the composition comprises at least about 95% w/w creosote.

17. The composition of claim 1, wherein the $C_2$-$C_6$ monoalkanolamine ester of boric acid comprises a monoethanolamine ester of boric acid; and the reaction product further comprises boric acid.

18. A wood treatment composition comprising:

(1) at least about 3% w/w of a reaction product of monoethanolamine and boric acid, wherein the reaction product comprises boric acid and a monoethanolamine ester of boric acid;

2) at least about 90% w/w creosote; and 3) biodiesel;

wherein the composition is a homogeneous mixture and is greater than 98% free of water.

19. The composition of claim 18, wherein the composition comprises at least 3% by weight of the monoethanolamine ester of boric acid.

20. The composition of claim 18, wherein the reaction product is formed from a mixture which includes 23-43 wt. % monoethanolamine and 40-60 wt. % boric acid.

21. The composition of claim 18, wherein the reaction product and the biodiesel are present in a ratio of 0.5:0.5 to 0.9:0.1.

22. The composition of claim 18, wherein the reaction product is formed from a mixture which includes 31-35 wt. % monoethanolamine and 48-52 wt. % boric acid.

23. A wood treatment composition consisting essentially of:

(1) at least about 3% w/w of a reaction product of monoethanolamine and boric acid, wherein the reaction product comprises boric acid and a monoethanolamine ester of boric acid;

(2) about 90 to 97% w/w creosote; and (3) biodiesel;

wherein the reaction product is formed from a mixture which includes 23-43 wt. % monoethanolamine and 40-60 wt. % boric acid; and the reaction product and the biodiesel are present in a ratio of 0.5:0.5 to 0.9:0.1; the composition is greater than 98% free of water and is a homogeneous mixture; the composition comprises at least 3% by weight of the monoethanolamine ester of boric acid.

* * * * *